US008186819B2

(12) United States Patent
Kaiho

(10) Patent No.: US 8,186,819 B2
(45) Date of Patent: May 29, 2012

(54) IMAGE FORMING APPARATUS AND METHOD FOR CONTROLLING INK EJECTION

(75) Inventor: Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1094 days.

(21) Appl. No.: 12/055,856

(22) Filed: Mar. 26, 2008

(65) Prior Publication Data

US 2009/0051722 A1 Feb. 26, 2009

Related U.S. Application Data

(60) Provisional application No. 60/957,329, filed on Aug. 22, 2007.

(51) Int. Cl.
*B41J 2/18* (2006.01)
*B41J 2/175* (2006.01)

(52) U.S. Cl. ..... 347/89; 347/85; 347/93

(58) Field of Classification Search ..... None
See application file for complete search history.

(56) References Cited

FOREIGN PATENT DOCUMENTS

| | | |
|---|---|---|
| JP | 10-006521 | 1/1998 |
| JP | 11-192717 | 7/1999 |
| JP | 11-348300 | 12/1999 |
| JP | 2000-141695 | 5/2000 |
| JP | 2006-289955 | 10/2006 |
| WO | WO 2006064040 A1 * | 6/2006 |

OTHER PUBLICATIONS

Japanese Office Action for Japanese Patent Application No. 2008-119886 mailed on Dec. 6, 2011.

* cited by examiner

*Primary Examiner* — Matthew Luu
*Assistant Examiner* — Erica Lin
(74) *Attorney, Agent, or Firm* — Turocy & Watson, LLP

(57) ABSTRACT

An image forming apparatus includes an inkjet head, a first tank and a second tank, a first flow path, a second flow path, a third flow path, and a negative pressure control mechanism that controls negative pressure in the first tank and the second tank. The negative pressure control mechanism alternately switches a first phase in which the ink is delivered from the first tank to the second tank, and a second phase in which the ink is delivered from the second tank to the first tank. The inkjet head ejects the ink both in the first phase and in the second phase.

16 Claims, 7 Drawing Sheets

IMAGE FORMING APPARATUS AND METHOD FOR CONTROLLING INK EJECTION

CROSS-REFERENCE TO RELATED APPLICATIONS

This application claims the benefit of U.S. Provisional Application No. 60/957,329, filed Aug. 22, 2007.

BACKGROUND OF THE INVENTION

1. Field of the Invention

The present invention relates to ink circulation in an image forming apparatus using an inkjet head.

2. Description of the Related Art

Conventionally, in an inkjet printer or the like using an inkjet head, a system of supplying circulated ink to the inkjet head is used as a recovery measure to eliminate bubbles and foreign matter from around an ink ejection port of the head. This circulation system is described in JP-A-2006-289955 and so on. Also, a mechanism to circulate ink for the purpose of eliminating bubbles from a tube is described in JP-A-11-192717.

However, in the system of JP-A-2006-289955, since ink is directly pressurized by a pump, modification and cavitation tend to occur in the ink. There is also a problem that the modified ink returns to the inkjet head and causes the image to be unstable. Meanwhile, in the system of JP-A-11-192717, ink cannot be circulated during printing. Therefore, there is a problem that bubbles cannot be eliminated from the inkjet head once they have been generated in or have entered the inkjet head.

BRIEF SUMMARY OF THE INVENTION

It is an object of the invention to provide an image forming apparatus and a method for controlling ink ejection in which ink can be circulated in an inkjet head while modification of the ink is prevented.

To achieve the above object, an image forming apparatus according to an aspect of the invention includes: an inkjet head capable of ejecting ink from a nozzle; a first tank and a second tank that are separately provided from the inkjet head and each of which stores ink therein and supplies the ink to the inkjet head; a first flow path that connects the inkjet head to the first tank; a second flow path that connects the inkjet head to the second tank; a third flow path that connects the first tank to the second tank; and a negative pressure control mechanism that controls negative pressure in the first tank and the second tank. The negative pressure control mechanism alternately switches a first phase in which a negative pressure is provided in the second tank and the first tank is opened to atmosphere so that the ink is delivered from the first tank to the second tank via the first flow path, the inkjet head and the second flow path, and a second phase in which a negative pressure is provided in the first tank and the second tank is opened to atmosphere so that the ink is delivered from the second tank to the first tank via the third flow path. The inkjet head ejects the ink both in the first phase and in the second phase.

To achieve the above object, a method for controlling ink ejection according to another aspect of the invention is used for an image forming apparatus including: an inkjet head capable of ejecting ink; a first tank and a second tank that are separately provided from the inkjet head and each of which stores ink therein and supplies the ink to the inkjet head; a first flow path that connects the inkjet head to the first tank; a second flow path that connects the inkjet head to the second tank; and a third flow path that connects the first tank to the second tank. The method includes the steps of: providing a negative pressure in the second tank and opening the first tank to atmosphere so that the ink is delivered from the first tank to the second tank via the first flow path, the inkjet head and the second flow path to be ejected from the inkjet head; and providing a negative pressure in the first tank and opening the second tank to atmosphere so that the ink is delivered from the second tank to the first tank via the third flow path to be ejected from the inkjet head. The step of providing a negative pressure in the second tank and the step of providing a negative pressure in the first tank are alternately switched.

According to the invention, an image forming apparatus and a method for controlling ink ejection can be provided in which ink can be circulated in an inkjet head while modification of the ink is prevented.

Objects and advantages of the invention will become apparent from the description which follows, or may be learned by practice of the invention.

BRIEF DESCRIPTION OF THE SEVERAL VIEWS OF THE DRAWINGS

The accompanying drawings illustrate embodiments of the invention, and together with the general description given above and the detailed description given below, serve to explain the principles of the invention.

DETAILED DESCRIPTION OF THE INVENTION

Figure 1:
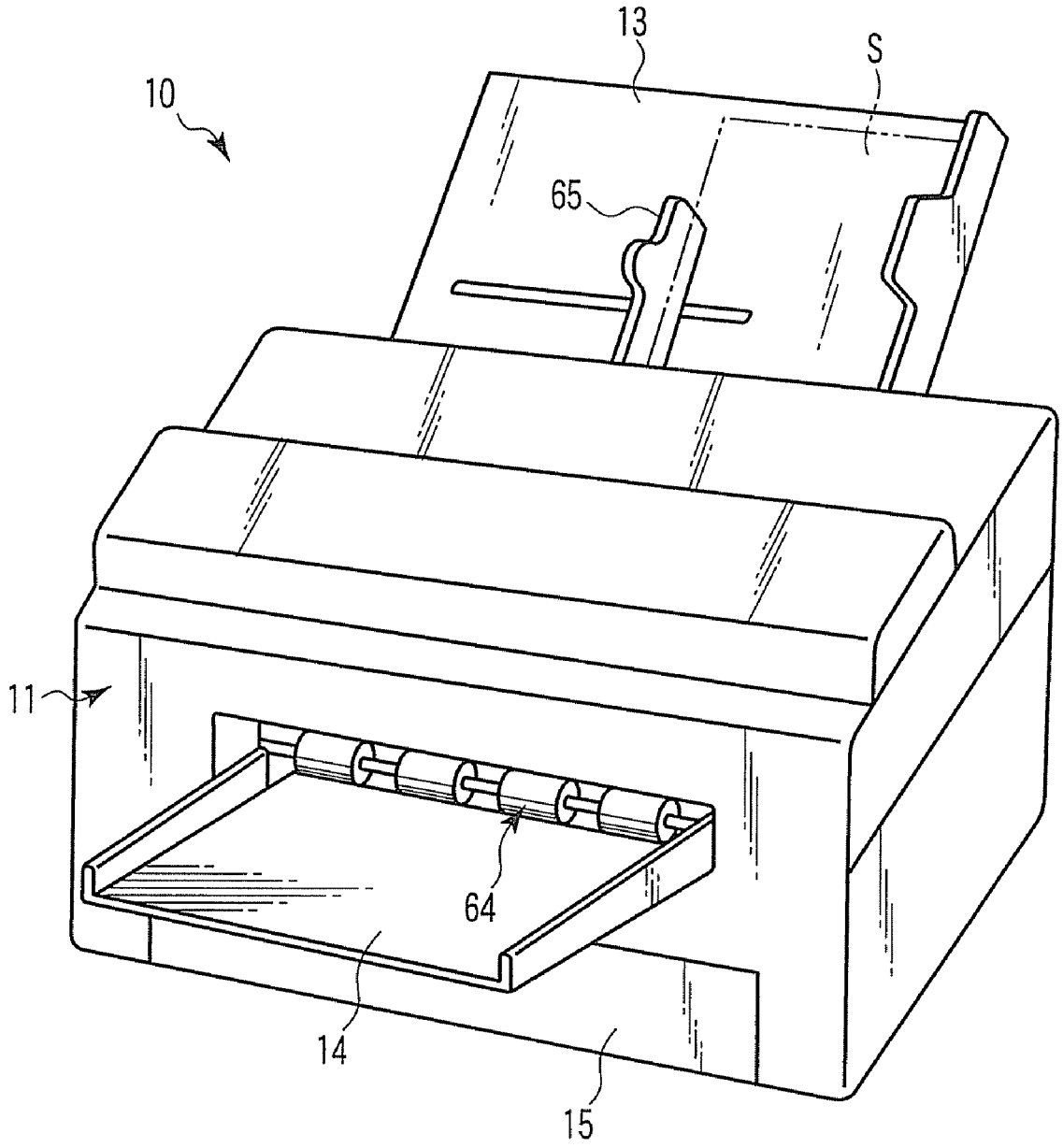
FIG. 1 is a perspective view showing an image forming apparatus according to a first embodiment.
Figure 2:
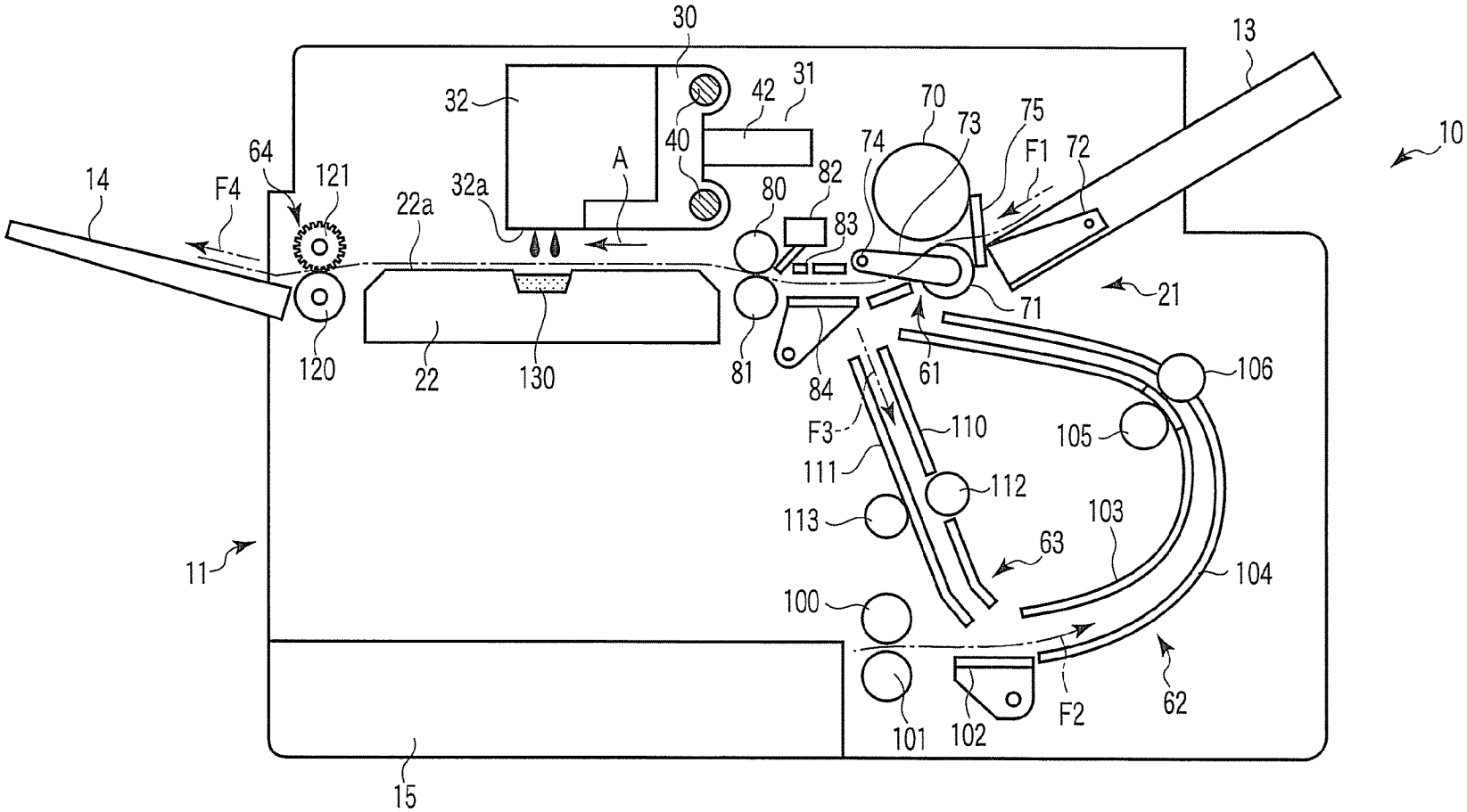
FIG. 2 is a schematic side view showing the image forming apparatus shown in FIG. 1, as viewed from the lateral side.
Figure 3:
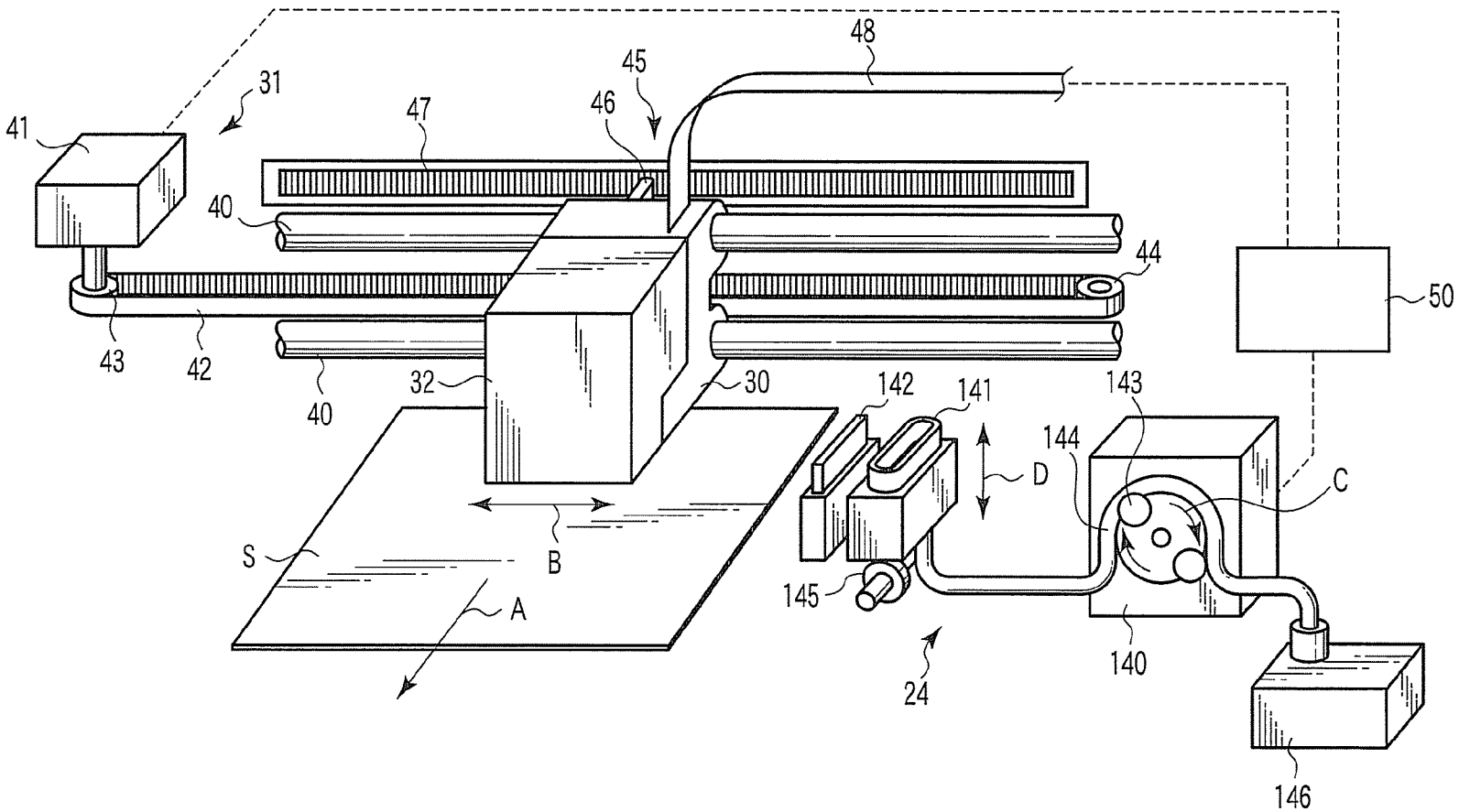
FIG. 3 is a perspective view showing the peripheral structure of an inkjet head of the image forming apparatus shown in FIG. 1.

Hereinafter, embodiments of the invention will be described with reference to the drawings. FIG. 1 to FIG. 3 show the overall configuration of an image forming apparatus of this embodiment.

An image forming apparatus 10 has an apparatus body 11. A first supply tray 13 is arranged on the rear side of this apparatus body 11. A discharge tray 14 is arranged on the front side. A second supply tray 15 is provided on the bottom side of the apparatus body 11.

FIG. 2 schematically shows the internal configuration of the image forming apparatus 10. The apparatus body 11 includes a sheet carrying mechanism 21 as a carrier device, a sheet guide 22 as a medium guide having a horizontal guide surface 22*a*, a head cleaning mechanism 24 shown in FIG. 3, and so on.

A carriage 30, a carriage driving mechanism 31 for driving this carriage 30, an inkjet head 32 as an inkjet recording device loaded on the carriage 30 and the like are arranged above the sheet guide 22.

As shown in FIG. 2, the inkjet head 32 has a nozzle 32*a* facing the guide surface 22*a* of the sheet guide 22, and an ink ejection mechanism (not shown) that ejects ink from this nozzle 32*a*. The inkjet head 32 forms an image on a sheet S shown in FIG. 3 with this ink. An arrow A in FIG. 3 indicates the carrying direction of the sheet S.

An example of the ink ejection mechanism is a thermal type. In the thermal type, a heater arranged in the inkjet head 32 heats ink and thus causes film-boiling of the ink. Growth of bubbles due to this film-boiling causes change in pressure on the ink. As the ink is ejected from the nozzle 32*a* by this change in pressure, an image is formed on the sheet S.

Other than the thermal type, for example, an ink ejection mechanism using a device having a piezoelectric effect (for example, a piezoelectric device) may be employed. For example, the piezoelectric device is deformed by a current, and by a pumping effect based on the deformation, the ink is ejected from the nozzle part.

As shown in FIG. 3, the carriage driving mechanism 31 has a carriage guide 40 extending horizontally, a motor 41 such as a stepping motor, power transmission members including a timing belt 42 and sprockets 43 and 44, a sensor unit 45 to control the position of the carriage 30, and so on.

The carriage guide 40 extends in a direction B orthogonal to the carrying direction of the sheet S. The carriage guide 40 is supported on a frame of the apparatus body 11. The inkjet head 32 is moved back and forth together with the carriage 30 along the carriage guide 40, in the direction (direction of the arrow B) perpendicular to the carrying direction of the sheet S.

The rotation of the motor 41 is transmitted to the carriage 30 via the timing belt 42. Therefore, the inkjet head 32 moves back and forth along the carriage guide 40. The sensor unit 45 to control the position of the carriage 30 has, for example, an encoder sensor 46, and a ladder plate 47 as a detection subject. The ladder plate 47 extends in a direction parallel to the carriage guide 40. The ladder plate 47 has ladder patterns formed at an equal pitch. As the ladder patterns of the ladder plate 47 are optically detected by the encoder sensor 46 in accordance with the position of the carriage 30, the position of the carriage 30 is detected. The detected position signal is inputted to a control unit 50 via a flexible harness 48.

As shown in FIG. 2, the sheet carrying mechanism 21 includes a first carrying section 61, a second carrying section 62, a double-side print carrying section 63 used for carrying out double-side print, a discharge mechanism 64, and so on.

The first carrying section 61 carries a sheet taken out of the first supply tray 13 toward the inkjet head 32. The second carrying section 62 carries a sheet taken out of the second supply tray 15 toward the inkjet head 32. The discharge mechanism 64 is responsible for the function of discharging a printed sheet onto the discharge tray 14.

Plural sheets (for example, print sheets) can be stacked in the direction of thickness and thus set on the first supply tray 13. As shown in FIG. 1, a movable guide 65 is provided on the first supply tray 13. The movable guide 65 is movable in the direction of width of the sheet S in accordance with the size of the sheet S. As this movable guide 65 is moved in the direction of width of the sheet S, the position in the direction of width of the sheet S on the first supply tray 13 can be regulated.

The first carrying section 61 includes a supply roller 70, a separation roller 71 situated below the supply roller 70, a separation unit 72 including a separation pad, and so on. The supply roller 70 supplies a sheet taken out from the lower end of the first supply tray 13 toward the inkjet head 32.

A torque limiter is provided in the separation roller 71. With the function of the torque limiter, the separation roller 71 rotates in the same direction as the supply roller 70 when only one sheet exists between the supply roller 70 and the separation roller 71. When two or more sheets exist between the supply roller 70 and the separation roller 71, the separation roller 71 rotates in the opposite direction to the supply roller 70. Therefore, when plural sheets are taken out of the first supply tray 13 and sent into the part between the supply roller 70 and the separation roller 71, the uppermost sheet and the other sheets are separated and only the uppermost sheet is supplied to the inkjet head 32. These supply roller 70, separation roller 71, separation unit 72 and the like form a sheet separation mechanism for taking out sheets one by one from the first supply tray 13.

The separation roller 71 is held by a holder 73. The holder 73 is movable upward and downward about a shaft 74 which extends horizontally. The separation roller 71 is abutted against the supply roller 70 with a predetermined load by a spring and is separated from the supply roller 70 by a cam, not shown. The separation unit 72 can be moved in directions toward and away from the supply roller 70 by a cam, not shown.

After supplying a sheet, the separation roller 71 and the separation unit 72 are separated respectively from the supply roller 70, move to the standby position, and wait for the next sheet supply. A return lever 75 is arranged in a manner that enables the return lever to turn, near the lower end of the first supply tray 13. When a sheet taken out of the first supply tray 13 is carried toward the supply roller 70, the return lever 75 retreats by a spring to a position where it does not obstruct the carrying of the sheet. This return lever 75 turns synchronously with the movement of the separation roller 71 and the separation unit 72 to the standby position, and returns the remaining sheets to the first supply tray 13.

The first carrying section 61 has carrying rollers 80, pinch rollers 81 facing these carrying rollers 80, a sheet sensor 82, a medium sensor 83, a switching member 84 and so on. The carrying rollers 80 supply a sheet between the sheet guide 22 and the inkjet head 32. The sheet sensor 82 has a sensor arm capable of detecting the position of the forward edge and the rear edge of the sheet.

The medium sensor 83 has the function of detecting the quality of the sheet (for example, paper quality). For example, in the case where the surface of a sheet is made of a moisture-absorptive material, a signal to increase the quantity of ink to be ejected from the inkjet head 32 is outputted to the control unit 50. Meanwhile, in the case of a sheet having a glossy surface, for example, coat paper, control is performed so that a signal to decrease the quantity of ink to be ejected from the inkjet head 32 is outputted to the control unit 50. Moreover, in the case of color print, the rate of ejection of plural color components may be adjusted in accordance with a signal from the medium sensor 83.

Figure 4:
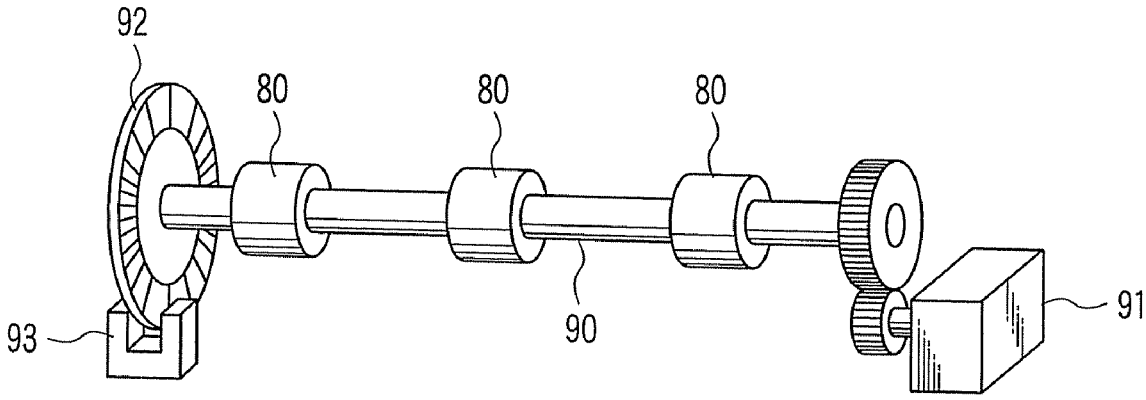
FIG. 4 is an enlarged perspective view showing the peripheral structure of carrying rollers of the image forming apparatus shown in FIG. 1.

As shown in FIG. 4, the carrying rollers 80 are attached to a shaft 90. The shaft 90 is rotated by a controllable motor 91 such as a stepping motor. The pinch rollers 81 facing the carrying rollers 80 are abutted against the carrying rollers 80 by springs, not shown. A disc-like ladder wheel 92 is attached to the shaft 90 of the carrying rollers 80. On the ladder wheel 92, ladder patterns are formed at a predetermined pitch in the circumferential direction. This ladder wheel 92 is detected by a sensor 93 and the result is inputted to the control unit 50. Thus, the rotation of the carrying rollers 80 is controlled and the carrying of the sheet is controlled at the time of image formation.

A sheet taken out of the first supply tray 13 by the supply roller 70 passes through the first carrying section 61 as indicated by an arrow F1 in FIG. 2, and is carried to the part between the carrying rollers 80 and the pinch rollers 81. The distal end of the sheet is detected by the sheet sensor 82 and positioning for image formation is carried out. As the carrying rollers 80 rotate, this sheet passes between the top surface (guide surface 22*a*) of the sheet guide 22 and the inkjet head 32. At this time, an image is formed on the sheet S by the inkjet head 32. Ribs that function as a carrying reference surface are formed on the guide surface 22*a* of the sheet guide 22. These ribs maintain the height of the sheet at a proper level and restrain corrugation of the sheet. The sheet with an image formed thereon is carried toward the discharge mechanism 64.

The second carrying section 62 has rollers 100 and 101 for taking out a sheet from the cassette-type second supply tray 15, a switching member 102, guide members 103 and 104 for guiding the sheet that is taken out, a carrying roller 105 provided at a halfway part of the guide members 103 and 104, and a pinch roller 106 facing the carrying roller 105. The pinch roller 106 is pressed toward the carrying roller 105 by a spring. On the second supply tray 15, plural sheets (for example, print sheets) can be stacked in the direction of thickness and thus housed. The rollers 100 and 101 of the second carrying section 62 function as a sheet separation mechanism for taking out the sheets one by one from the second supply tray 15.

A sheet that is taken out of the second supply tray 15 passes through the guide members 103 and 104 of the second carrying section 62 via the switching member 102, as indicated by an arrow F2 in FIG. 2. Moreover, this sheet is carried toward the carrying rollers 80 by the rollers 105 and 106 and then supplied to the part between the inkjet head 32 and the sheet guide 22.

The double-side print carrying section 63 has guide members 110 and 111, a carrying roller 112 provided at a halfway part of the guide members 110 and 111, a pinch roller 113 facing the carrying roller 112, and so on. The pinch roller 113 is pressed toward the carrying roller 112 by a spring. The guide members 110 and 111 are arranged between the switching member 84 of the first carrying section 61 and the switching member 102 of the second carrying section 62. At the time of double-side print, a sheet is passed in the direction of an arrow F3 in FIG. 2. The carrying rollers 80, 105 and 112 include a metal shaft with rubber-like resin such as EPDM provided thereon, and have the function of carrying the sheet S by friction. In the case of carrying out double-side print, after printing is done on one side of the sheet by the inkjet head 32, the rear edge of this sheet is detected by the sheet sensor 82. Immediately after that, the carrying rollers 80 rotate backward and the position of the switching member 84 is switched. Thus, the sheet is sent to the double-side print carrying section 63, as indicated by the arrow F3 in FIG. 2. Moreover, this sheet is carried by the rollers 112 and 113, and passes through the guide members 103 and 104 of the second carrying section 62 via the switching member 102. In this manner, the sheet is inverted. As this sheet is sent again to the inkjet head 32 by the carrying rollers 80, printing is performed on the other side of the sheet.

The discharge mechanism 64 has a discharge roller 120, a star wheel 121, a transmission mechanism (not shown) for transmitting the rotation of the carrying rollers 80 to the discharge roller 120 and the star wheel 121, and so on. The star wheel 121 is a gear-like wheel made of a stainless steel thin plate. The sheet on which printing has been done by the inkjet head 32 is carried in the direction indicated by an arrow F4 toward the discharge tray 14, while the sheet is pressed to the discharge roller 120 by the star wheel 121. By this star wheel 121, the sheet after printing is prevented from rising from the discharge roller 120.

The head cleaning mechanism 24 shown in FIG. 3 has a suction pump 140 for cleaning the inkjet head 32, a cap 141 for preventing the inkjet head 32 from drying, a blade member 142 for cleaning the nozzle 32*a* of the inkjet head 32, and so on. As an example of the suction pump 140, a tube 144 is squeezed in the direction indicated by an arrow C by a rotary body 143, and thus a negative pressure is generated within the cap 141.

The cap 141 can be moved upward and downward (the direction of an arrow D in FIG. 3) by a driving mechanism 145. The driving mechanism 145 moves the cap 141 up and down by using an electrically powered actuator (not shown), for example, a solenoid or the like, as a driving source. The cap 141 may also be moved up and down by conversion of the rotation of the motor to linear motion by a cam or a link mechanism or the like. When maintenance of the inkjet head 32 is performed, the cap 141 is raised toward the inkjet head 32 and the cap 141 is thus brought in tight contact with the inkjet head 32. As the suction pump 140 is actuated in this state, the residual ink adhering to the nozzle 32*a* of the inkjet head 32 is sucked. The waste ink that is sucked is discharged into a waste ink tank 146. After that, the cap 141 is moved away from the inkjet head 32. Moreover, the nozzle 32*a* of the inkjet head 32 is cleaned by the blade member 142.

Figure 5:
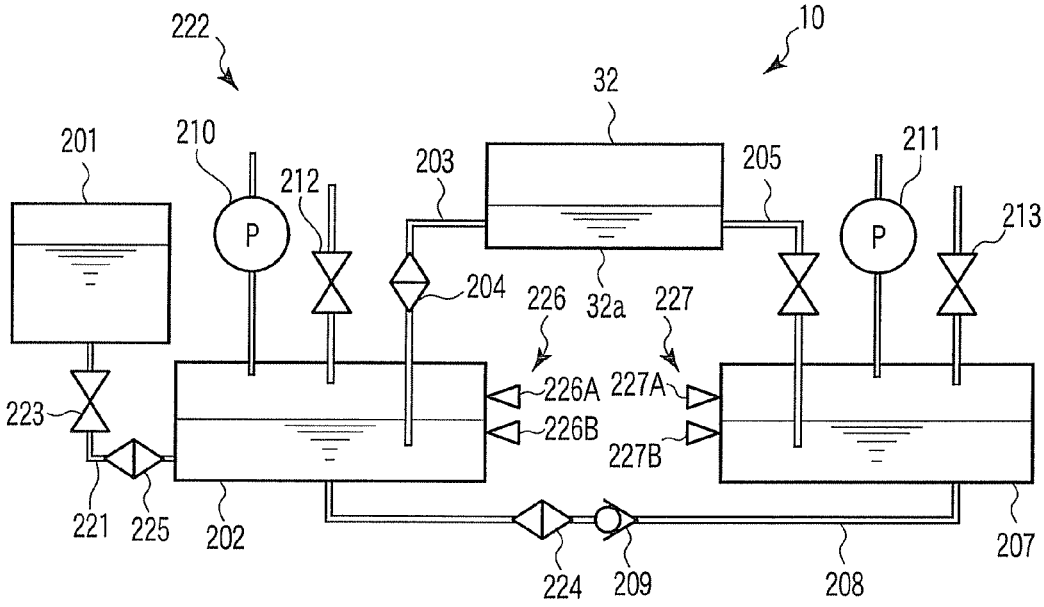
FIG. 5 is a systemic view showing the connection state of an ink circulation system of the image forming apparatus shown in FIG. 1.

Hereinafter, an ink circulation system of the image forming apparatus will be described with reference to FIG. 5. FIG. 5 is a systemic view showing the connection state of the ink circulation system according to the invention. The image forming apparatus 10 has a main tank 201 as a main storage unit that stores ink, a first tank 202 as a first storage unit to which the ink is supplied from the main tank 201 and in which the ink is temporarily stored before the ink is supplied to the inkjet head 32, a second tank 207 as a second storage unit that temporarily stores the ink discharged from the inkjet head 32, a negative pressure control mechanism 222 as a negative pressure control unit that controls the negative pressure in the first tank 202 and the second tank 207, a first sensor mechanism 226 as a first sensor unit that detects the liquid quantity of the ink stored in the first tank 202, and a second sensor mechanism 227 as a second sensor unit that detects the liquid quantity of the ink stored in the second tank 207.

The image forming apparatus 10 further includes a first flow path 203 that connects the inkjet head 32 to the first tank 202, a second flow path 205 that connects the inkjet head 32 to the second tank 207, a third flow path 208 that connects the first tank 202 to the second tank 207, and a fourth flow path 221 that connects the main tank 201 to the first tank 202. Each of the first to fourth flow paths 203, 205, 208 and 221 is formed in a tube-shape.

The image forming apparatus 10 also has an ink supply valve 223 provided at a halfway part of the fourth flow path 221, a back flow prevention valve 209 provided in the third flow path 208, a first filter 204 provided at a halfway part of the first flow path 203, a second filter 224 provided at a halfway part of the third flow path 208, and a third filter 225 provided at a halfway part of the fourth flow path 221.

The first sensor mechanism 226 has a first upper limit sensor 226A that detects that the ink in the first tank 202 has exceeded an upper threshold value, and a first lower limit sensor 226B that detects that the ink in the first tank 202 has fallen below a lower threshold value. The second sensor mechanism 227 has a second upper limit sensor 227A that detects that the ink in the second tank 207 has exceeded an upper threshold value, and a second lower limit sensor 227B that detects that the ink in the second tank 207 has fallen below a lower threshold value.

The negative pressure control mechanism 222 has a first pump 210 as first exhaust means that discharges air from the first tank 202, a first vent valve 212 as first vent means provided in the first tank 202, a second pump 211 as second exhaust means that discharges air from the second tank 207, a second vent valve 213 as second vent means provided in the second tank 207, and the control unit 50 as control means that controls the first pump 210, the first vent valve 212, the second pump 211 and the second vent valve 213. The first and second pumps 210 and 211 may be any type such as tube pumps or diaphragm pumps. The open ends, in the chambers, of the tubes connected to the first and second pumps 210 and 211 are prevented from reaching the liquid level. The first vent valve 212 and the second vent valve 213 are formed by electromagnetic valves controlled in open and close operation by the control unit 50.

Figure 6:
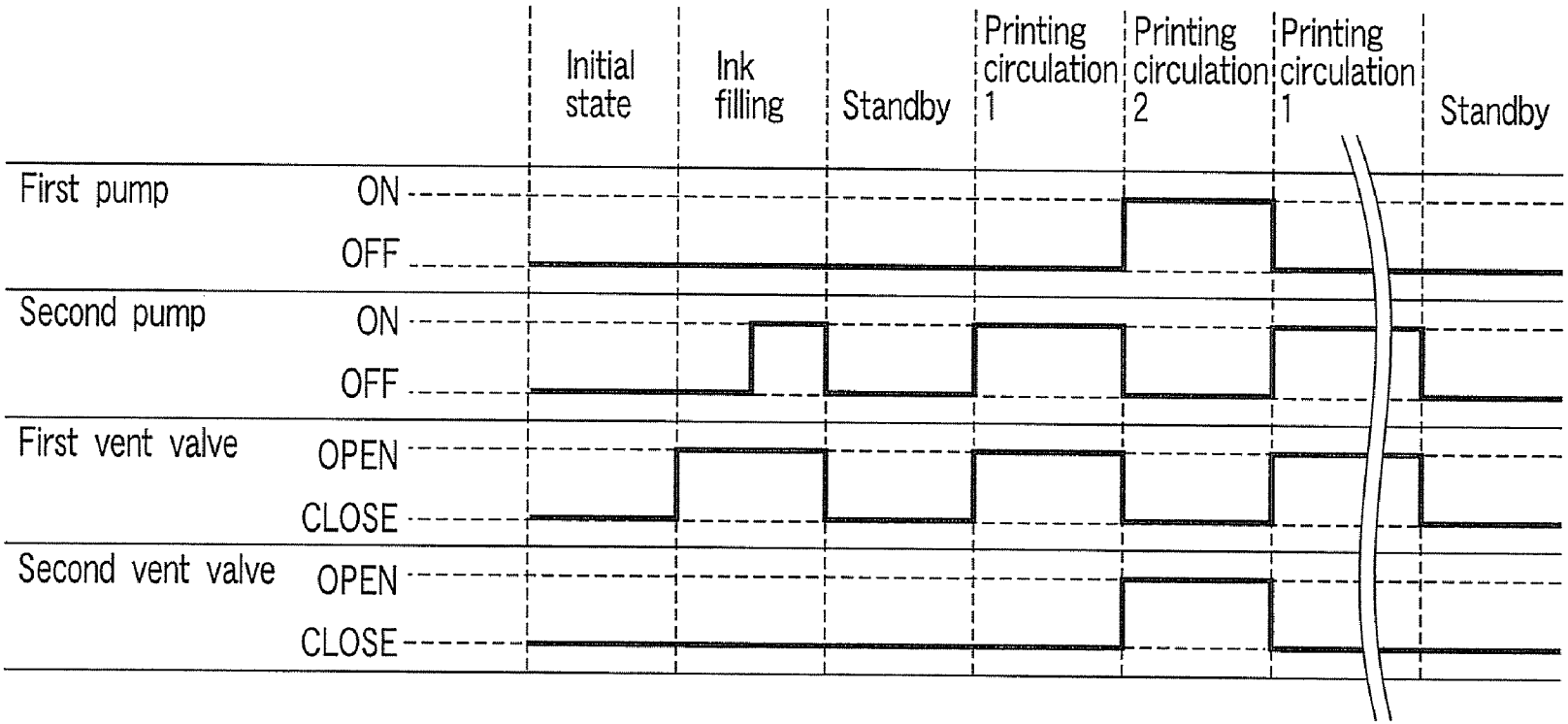
FIG. 6 is a timing chart showing a method for controlling ink ejection in the image forming apparatus shown in FIG. 1.

A method for controlling ink ejection in the image forming apparatus 10 will be described with reference to the timing chart of FIG. 6. In this method for controlling ink ejection, there is a first phase (first step) in which ink is delivered from the first tank 202 to the second tank 207, and a second phase (second step) in which ink is delivered from the second tank 207 to the first tank 202. In this control method, the first phase and the second phase are alternately switched.

In the method of controlling ink ejection according to this embodiment, there is an initial filing step prior to the first phase and the second phase. In the initial filling step, the first vent valve 212 is opened and an atmospheric pressure is provided in the first tank 202. At this time, the ink supply valve 223 opens and the ink is supplied from the main tank 201 to the first tank 202. This supply of the ink utilizes the head difference between the main tank 201 and the first tank 202.

When it is detected by the first upper limit sensor 226A of the first sensor mechanism 226 that the quantity of ink in the first tank 202 has reached an appropriate quantity, the control unit 50 (negative pressure control mechanism 222) causes the second pump 211 to operate and suck the ink. At this time, since the back flow prevention valve 209 is provided, the ink does not flow from the first tank 202 to the second tank 207 via the third flow path 208. The ink passes through the inkjet head 32 and the inkjet head 32 becomes filled with the ink. When it is detected by the second lower limit sensor 227B of the second sensor mechanism 227 that the quantity of ink in the second tank 207 has reached an appropriate quantity, the initial filling of the ink is completed and the apparatus enters the standby state.

Then, as the first phase is started, the first vent valve 212 opens and the second pump 211 is driven. Thus, the ink flows from the first tank 202 to the second tank 207 through the inkjet head 32. At the same time, print operation is started at the inkjet head 32 and an image is formed onto the sheet S. Since the first tank 202 is opened to atmosphere, the negative pressure in the inkjet head 32 is properly maintained. Therefore, the printing is not largely influenced by the negative pressure. Minute dust and bubbles that have entered the inkjet head 32 are caused to flow out of the inkjet head 32 as the ink circulates. Thus, even when dot missing due to dust or bubbles has occurred, recovery will soon be made.

When it is detected by the second upper limit sensor 227A that the quantity of ink in the second tank 207 has exceeded a predetermined upper threshold value, the control unit 50 (negative pressure control mechanism 222) stops the second pump 211. The first vent valve 212 closes and the second vent valve 213 opens. The first phase ends here. Then, as the second phase is started, the control unit 50 drives the first pump 210 to discharge air from the first tank 202 to outside. When the negative pressure in the first tank 202 is increased, the ink reflows from the second tank 207 to the first tank 202 through the third flow path 208 and the back flow prevention valve 209. At the same time, print operation is started at the inkjet head 32 and an image is formed onto the sheet S. At this time, the ink is prevented from flowing backward from the inkjet head 32 by the tube resistance of the filter 204. To realize the same function, a back flow prevention valve may be used instead of the filter 204. Since the second vent valve 213 is opened, the negative pressure in the inkjet head 32 is decided by the head difference between the inkjet head 32 and the second tank 207 and does not influence printing.

When it is detected by the second lower limit sensor 227B that the quantity of ink in the second tank 207 has fallen below a predetermined lower threshold value, the control unit 50 (negative pressure control mechanism 222) stops the first pump 210. The second phase ends here. Then, the first vent valve 212 opens and the second vent valve 213 closes. The first phase starts again. In this case, when it is detected by the first lower limit sensor 226B that the quantity of ink in the first tank 202 is less than a predetermined lower threshold value, the ink is properly supplied from the main tank 201. After that, the first phase (first step) and the second phase (second step) are alternately switched, and ink circulation and printing are carried out.

According to this embodiment, when the ink is circulated through the inkjet head 32 in order to solve image defects due to dust and bubbles in the head during printing, the ink does not pass through the pumps 210 and 211 and therefore there is no degradation of the ink due to the pressure in the pumps 210 and 211 and pressure change. Also, since the pumps 210 and 211 are used only to discharge air, entry of duct from outside can be prevented.

Now, a second embodiment of an image forming apparatus will be described with reference to FIG. 7. The image forming apparatus according to the second embodiment differs from the first embodiment in that a pump 231 is shared by the first tank 202 and the second tank 207, but the other parts are the same. Therefore, the feature different from the first embodiment will be mainly described. The same parts as those in the first embodiment are denoted by the same reference numerals and will not be described further in detail.

Figure 7:
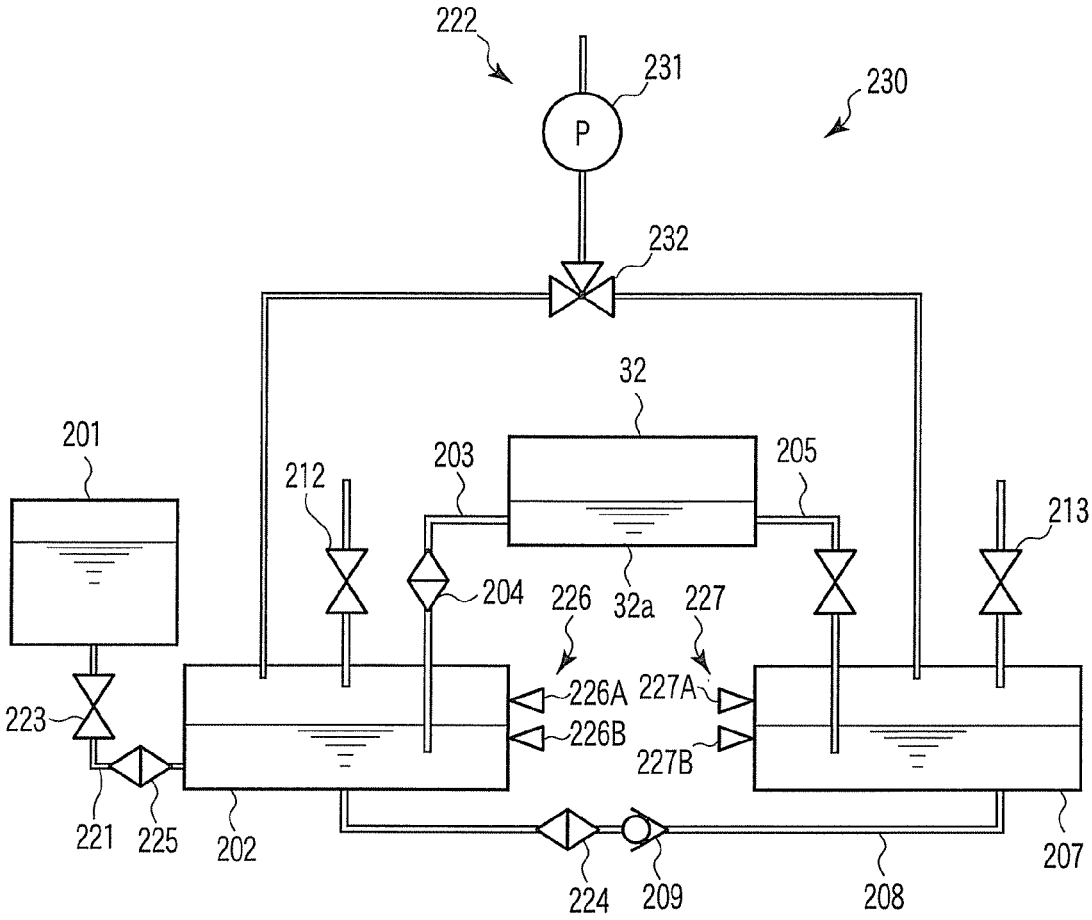
FIG. 7 is a perspective view showing an image forming apparatus according to a second embodiment.

As shown in FIG. 7, an image forming apparatus 230 according to the second embodiment has a pump 231 shared by the first tank 202 and the second tank 207, and a three-way valve 232 as a switching valve that switches the connection state between the pump 231, and the first tank 202 and the second tank 207. The three-way valve 232 can switch the state where the pump 231 is connected to the first tank 202 and the state where the pump 231 is connected to the second tank 207. The three-way valve 232 is formed by an electromagnetic valve controlled in open and close operation by the control unit 50.

A method for controlling ink ejection used for the image forming apparatus 230 according to the second embodiment will be briefly described.

In the initial filling step, the first vent valve 212 opens and an atmospheric pressure is provided in the first tank 202. At the same time, the ink supply valve 223 opens and the ink is supplied from the main tank 201 to the first tank 202. This supply of the ink utilizes the head difference between the main tank 201 and the first tank 202.

When it is detected by the first upper limit sensor 226A of the first sensor mechanism 226 that the quantity of ink in the first tank 202 has reached an appropriate quantity, the control unit 50 causes the pump 231 to operate, and also switches the three-way valve 232 to suck the ink in the state where the pump 231 is connected to the second tank 207. The ink passes through the inkjet head 32 and the inkjet head 32 becomes filled with the ink. When it is detected by the second lower limit sensor 227B of the second sensor mechanism 227 that the quantity of ink in the second tank 207 has reached an appropriate quantity, the initial filling of the ink is completed and the apparatus enters the standby state.

Then, as the first phase is started, the first vent valve 212 opens and the pump 231 is driven. Thus, the ink flows from the first tank 202 to the second tank 207 through the inkjet head 32. At the same time, print operation is started at the inkjet head 32 and an image is formed onto the sheet S. Since the first tank 202 is opened to atmosphere, the negative pressure in the inkjet head 32 is properly maintained. Therefore, the printing is not largely influenced by the negative pressure. Minute dust and bubbles that have entered the inkjet head 32 are caused to flow out of the inkjet head 32 as the ink circulates. Thus, even when dot missing due to dust or bubbles has occurred, recovery will soon be made.

When it is detected by the first upper limit sensor 227A that the quantity of ink in the second tank 207 has exceeded a predetermined upper threshold value, the control unit 50 stops the pump 231. The first vent valve 212 closes and the second vent valve 213 opens. The first phase ends here. Then, as the second phase is started, the control unit 50 drives the pump 231 and switches the three-way valve 232 to the state where the pump 231 is connected to the first tank 202. Thus, air in the first tank 202 is discharged to outside. When the negative pressure in the first tank 202 is increased, the ink reflows from the second tank 207 to the first tank 202 through the third flow path 208 and the back flow prevention valve 209. At this time, the ink is prevented from flowing backward from the inkjet head 32 by the tube resistance of the filter 204. Since the second vent valve 213 is opened, the negative pressure in the inkjet head 32 is decided by the head difference between the inkjet head 32 and the second tank 207 and does not influence printing.

When it is detected that the quantity of ink in the second tank 207 is an appropriate quantity, the pump 231 stops. Then, the first vent valve 212 opens and the second vent valve 213 closes. In this case, when it is detected by the first lower limit sensor 226B that the quantity of ink in the first tank 202 is less than a predetermined lower threshold value, the ink is properly supplied from the main tank 201. After that, the first phase (first step) and the second phase (second step) are alternately switched, and ink circulation and printing are carried out.

According to the second embodiment, since the pump 231 can be shared by the first tank 202 and the second tank 207, the number of pumps can be reduced and the configuration of the ink circulation system can be simplified.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. An image forming apparatus comprising:

an inkjet head capable of ejecting ink from a nozzle;

a first tank and a second tank that are separately provided from the inkjet head and each of which stores ink therein and supplies the ink to the inkjet head;

a first flow path that connects the inkjet head to the first tank;

a second flow path that connects the inkjet head to the second tank;

a third flow path that connects the first tank to the second tank; and a negative pressure control mechanism that controls negative pressure in the first tank and the second tank;

wherein the negative pressure control mechanism has a pump mechanism that provides a negative pressure in the first tank and the second tank, and the pump mechanism is provided at a position off of the first to third flow paths, and wherein the negative pressure control mechanism alternately switches a first phase in which a negative pressure is provided in the second tank and the first tank is opened to atmosphere so that the ink is delivered from the first tank to the second tank via the first flow path, the inkjet head and the second flow path, and a second phase in which a negative pressure is provided in the first tank and the second tank is opened to atmosphere so that the ink is delivered from the second tank to the first tank via the third flow path.

2. The image forming apparatus according to claim 1, wherein the negative pressure control mechanism has:

a first pump provided with the pump mechanism so that the first pump is connected to the first tank, that performs exhaust from inside and provides a negative pressure in the first tank;

a first vent valve for opening the first tank to atmosphere;

a second pump provided with the pump mechanism so that the second pump is connected to the second tank, that performs exhaust from inside and provides a negative pressure in the second tank;

a second vent valve for opening the second tank to atmosphere; and a control unit configured to control the first pump, the first vent valve, the second pump, and the second vent valve.

3. The image forming apparatus according to claim 2, further comprising a second sensor mechanism that detects quantity of the ink stored in the second tank, wherein when the quantity of the ink in the second tank exceeds a predetermined upper threshold value in the first phase, the control unit of the negative pressure control mechanism switches to the second phase, and when the quantity of the ink in the second tank is less than a predetermined lower threshold value in the second phase, the control unit of the negative pressure control mechanism switches to the first phase.

4. The image forming apparatus according to claim 3, further comprising:

a first sensor mechanism that detects quantity of the ink stored in the first tank; and a main tank that is connected to the first tank and stores ink therein;

wherein when the quantity of the ink in the first tank is less than a predetermined lower threshold value, the control unit of the negative pressure control mechanism supplies the ink from the main tank to the first tank.

5. The image forming apparatus according to claim 1, wherein the negative pressure control mechanism has:

a pump provided with the pump mechanism, that performs exhaust from inside and provide a negative pressure in the first tank and the second tank;

a switching valve that switches a first state where the first tank is connected to the pump and a second state where the second tank is connected to the pump;

a first vent valve for opening the first tank to atmosphere;

a second vent valve for opening the second tank to atmosphere; and a control unit configured to control the pump, the switching valve, the first vent valve, and the second vent valve.

6. The image forming apparatus according to claim 5, further comprising a second sensor mechanism that detects quantity of the ink stored in the second tank, wherein when the quantity of the ink in the second tank exceeds an upper threshold value in the first phase, the control unit of the negative pressure control mechanism switches to the second phase, and when the quantity of the ink in the second tank is less than a lower threshold value in the second phase, the control unit of the negative pressure control mechanism switches to the first phase.

7. The image forming apparatus according to claim 6, further comprising:

a first sensor mechanism that detects quantity of the ink stored in the first tank; and a main tank that is connected to the first tank and stores ink therein;

wherein when the quantity of the ink in the first tank is less than a predetermined lower threshold value, the control unit of the negative pressure control mechanism supplies the ink from the main tank to the first tank.

8. A method for controlling ink ejection used for an image forming apparatus comprising:

an inkjet head capable of ejecting ink;

a first tank and a second tank that are separately provided from the inkjet head and each of which stores ink therein and supplies the ink to the inkjet head;

a first flow path that connects the inkjet head to the first tank;

a second flow path that connects the inkjet head to the second tank;

a third flow path that connects the first tank to the second tank; and a pump mechanism provided at a position off of the first to third flow paths, that provides a negative pressure in the first tank and the second tank, the method comprising:

providing a negative pressure in the second tank and opening the first tank to atmosphere so that the ink is delivered from the first tank to the second tank via the first flow path, the inkjet head and the second flow path to be ejected from the inkjet head; and providing a negative pressure in the first tank and opening the second tank to atmosphere so that the ink is delivered from the second tank to the first tank via the third flow path to be ejected from the inkjet head;

wherein the step of providing a negative pressure in the second tank and the step of providing a negative pressure in the first tank are alternately switched.

9. The method for controlling ink ejection according to claim 8, wherein when the quantity of the ink in the second tank exceeds a predetermined upper threshold value in the step of providing a negative pressure in the second tank, the step of providing a negative pressure in the second tank is switched to the step of providing a negative pressure in the first tank, and when the quantity of the ink in the second tank is less than a predetermined lower threshold value in the step of providing a negative pressure in the first tank, the step of providing a negative pressure in the first tank is switched to the step of providing a negative pressure in the second tank.

10. The method for controlling ink ejection according to claim 9, wherein the method is used for the image forming apparatus further comprising a main tank that is connected to the first tank and stores ink therein, and when the quantity of the ink in the first tank is less than a predetermined lower threshold value, the ink is supplied from the main tank to the first tank.

11. An image forming apparatus comprising:

an inkjet head capable of ejecting ink from a nozzle;

first storage means and second storage means that are separately provided from the inkjet head and each of which is adapted for storing ink therein and supplying the ink to the inkjet head;

a first flow path that connects the inkjet head to the first storage means;

a second flow path that connects the inkjet head to the second storage means;

a third flow path that connects the first storage means to the second storage means; and negative pressure control means for controlling negative pressure in the first storage means and the second storage means;

wherein the negative pressure control means has a pump mechanism that provides a negative pressure in the first tank and the second tank, and the pump mechanism is provided at a position off of the first to third flow paths, and wherein the negative pressure control means alternately switches a first phase in which a negative pressure is provided in the second storage means and the first storage means is opened to atmosphere so that the ink is delivered from the first storage means to the second storage means via the first flow path, the inkjet head and the second flow path, and a second phase in which a negative pressure is provided in the first storage means and the second storage means is opened to atmosphere so that the ink is delivered from the second storage means to the first storage means via the third flow path.

12. The image forming apparatus according to claim 11, wherein the negative pressure control means has:

first exhaust means provided with the pump mechanism, for performing exhaust from inside and providing a negative pressure in the first storage means;

first vent means for opening the first storage means to atmosphere;

second exhaust means provided with the pump mechanism, for performing exhaust from inside and providing a negative pressure in the second storage means;

second vent means for opening the second storage means to atmosphere; and control means for controlling the first exhaust means, the first vent means, the second exhaust means, and the second vent means.

13. The image forming apparatus according to claim 12, further comprising second sensor means for detecting quantity of the ink stored in the second storage means, wherein when the quantity of the ink in the second storage means exceeds a predetermined upper threshold value in the first phase, the control means of the negative pressure control means switches to the second phase, and when the quantity of the ink in the second storage means is less than a predetermined lower threshold value in the second phase, the control means of the negative pressure control means switches to the first phase.

14. The image forming apparatus according to claim 13, further comprising:

first sensor means for detecting quantity of the ink stored in the first storage means; and main storage means that is connected to the first storage means and adapted for storing ink therein;

wherein when the quantity of the ink in the first storage means is less than a predetermined lower threshold value, the control means of the negative pressure control means supplies the ink from the main storage means to the first storage means.

15. The image forming apparatus according to claim 1, wherein the inkjet head ejects the ink both in the first phase and in the second phase.

16. The image forming apparatus according to claim 11, wherein the inkjet head ejects the ink both in the first phase and in the second phase.

* * * * *